US006003213A

United States Patent [19]

Keller et al.

[11] Patent Number: 6,003,213

[45] Date of Patent: Dec. 21, 1999

[54] BALL AND SOCKET BUCKLE

[75] Inventors: Steven C. Keller, Island Lake; Kenneth LeVey, West Chicago, both of Ill.

[73] Assignee: Illinois Tool Works Inc., Glenview, Ill.

[21] Appl. No.: 09/228,871

[22] Filed: Jan. 11, 1999

[51] Int. Cl.[6] ..... A44B 11/00

[52] U.S. Cl. ..... 24/635; 24/615; 24/645

[58] Field of Search ..... 24/635, 634, 642, 24/645, 651, 615, 616

[56] References Cited

U.S. PATENT DOCUMENTS

| | | | |
|---|---|---|---|
| 76,706 | 4/1868 | Brevoort . | |
| 2,743,894 | 5/1956 | Ostnas . | |
| 3,066,501 | 12/1962 | Charles et al. . | |
| 3,161,930 | 12/1964 | Crosson . | |
| 3,171,183 | 3/1965 | Johnston | 24/635 |
| 3,585,692 | 6/1971 | Le Mire | 24/635 |
| 3,713,192 | 1/1973 | Wallin | 24/645 |
| 4,304,403 | 12/1981 | Wilson . | |
| 4,369,552 | 1/1983 | Gotlieb . | |
| 4,559,679 | 12/1985 | Downey | 24/615 |
| 4,688,337 | 8/1987 | Dillner et al. | 24/615 |
| 4,709,949 | 12/1987 | Umezawa et al. | 24/645 |
| 5,027,481 | 7/1991 | Frano | 24/635 |
| 5,377,394 | 1/1995 | Fildan . | |
| 5,509,181 | 4/1996 | Yuuki et al. . | |
| 5,653,009 | 8/1997 | Kassardjian . | |

*Primary Examiner*—Victor N. Sakran
*Attorney, Agent, or Firm*—Schwartz & Weinrieb

[57] ABSTRACT

A buckle including a first buckle portion having an engagement member and a second buckle portion having socket arms forming a socket for releasably engaging the engagement member. A sleeve member is reciprocatably disposed about the socket arms between first, second and third positions, whereby the sleeve member in the first position prevents expansion of the socket arms so as to retain the engagement member, and the socket arms are expandable when the sleeve member is in the second and third positions so as to permit release of the engagement member from the socket and insertion of the engagement member into the socket.

21 Claims, 4 Drawing Sheets

BALL AND SOCKET BUCKLE

FIELD OF THE INVENTION

The present invention relates generally to mating buckles members useable for fastening end portions of web-like materials.

1. Background of the Invention

Mating buckle members are known generally and used widely, for example to secure extremities, or end portions, of web-like materials including straps used on child restraint harnesses, personal flotation devices, waste and back pack belts, head protection gear, and luggage and hand-bags, among many other applications.

The present invention is drawn toward advancements in the art of buckles useable for fastening end portions of web-like materials.

2. Objects of the Invention

An object of the invention is to provide novel mating buckle members that overcome problems in the art, and that are economical.

Another object of the invention is to provide novel mating buckle members that are relatively easy to engage and disengage, or connect and release.

A further object of the invention is to provide novel mating buckle members that are releasable independently of any load applied to the mating buckle members.

Another object of the invention is to provide novel mating buckle members that are lockable so as to prevent inadvertent or accidental separation thereof.

Another object of the invention is to provide novel mating buckle members having separate release and retention features.

Still another object of the invention is to provide novel mating buckle members having a rotatable and pivotable, or swivel, coupling therebetween.

Yet another object of the invention is to provide novel mating buckle members that may be connected or fastened by inserting an engagement member of a first buckle portion into a socket opening in an end portion of a second buckle portion or into another socket opening on a side portion of the second buckle portion.

A more particular object of the invention is to provide a novel buckle comprising generally a first buckle portion having an engagement member and a second buckle portion having socket arms forming a socket for releasably engaging the engagement member. A sleeve member is reciprocatably disposed about the socket arms between a first position and a second position, and in some embodiments a third position, whereby the socket arms are not expandable, or are constricted, when the sleeve member is in the first position so as to prevent release of the engagement member, and the socket arms are expandable when the sleeve member is in the second position, and in some embodiments in the third position, so as to permit release of the engagement member from the socket and insertion of the engagement member into the socket.

BRIEF DESCRIPTION OF THE DRAWINGS

These and other objects, aspects, features and advantages of the present invention will become more fully apparent upon careful consideration of the following Detailed Description of the Invention and the accompanying Drawings, which may be disproportionate for ease of understanding, wherein like structure and steps are referenced generally by corresponding numerals and indicators, and wherein.

DETAILED DESCRIPTION OF THE INVENTION

Figure 1:
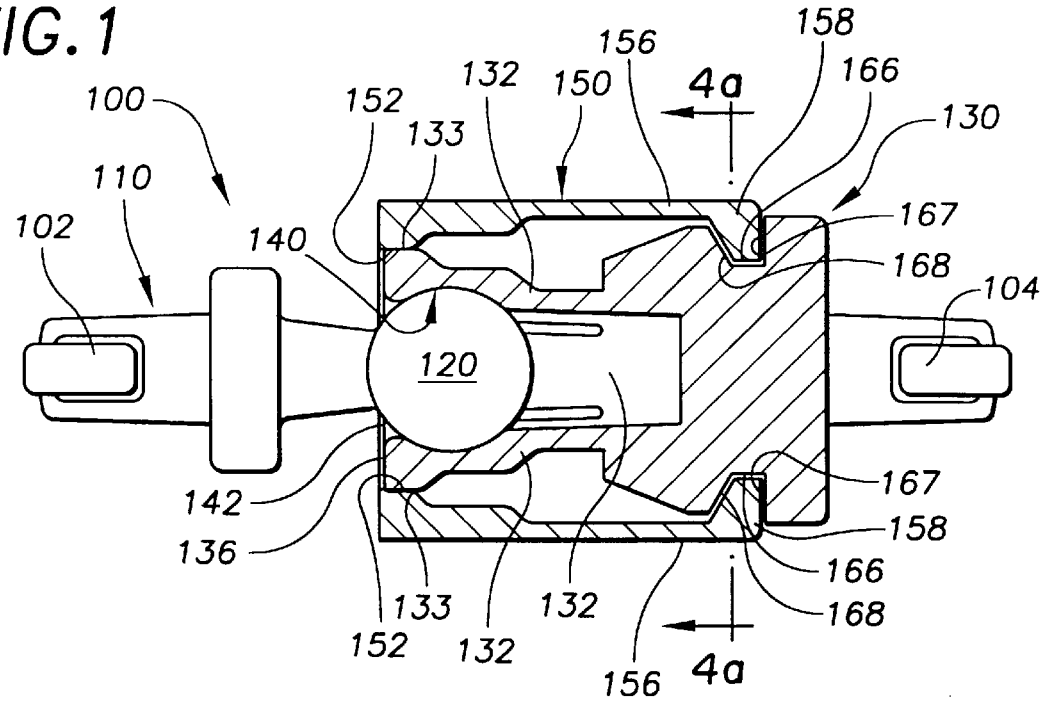
FIG. 1 is a partial sectional view of a buckle having first and second mating portions according to an exemplary embodiment of the invention.
Figure 2:
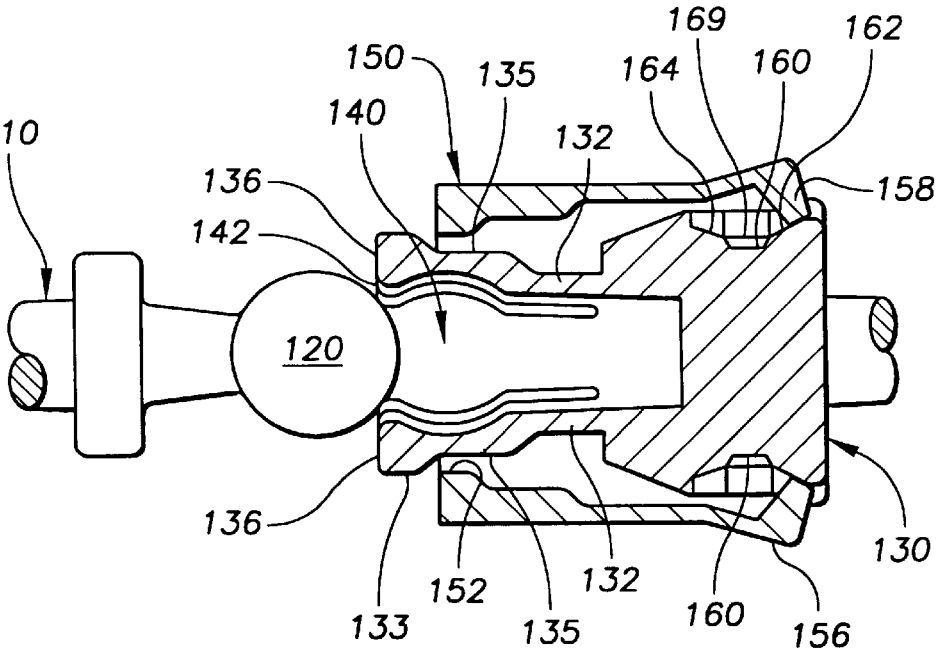
FIG. 2 is a partial sectional view of the buckle of FIG. 1 configured to connect and preferably to release the mating portions thereof.
Figure 3:
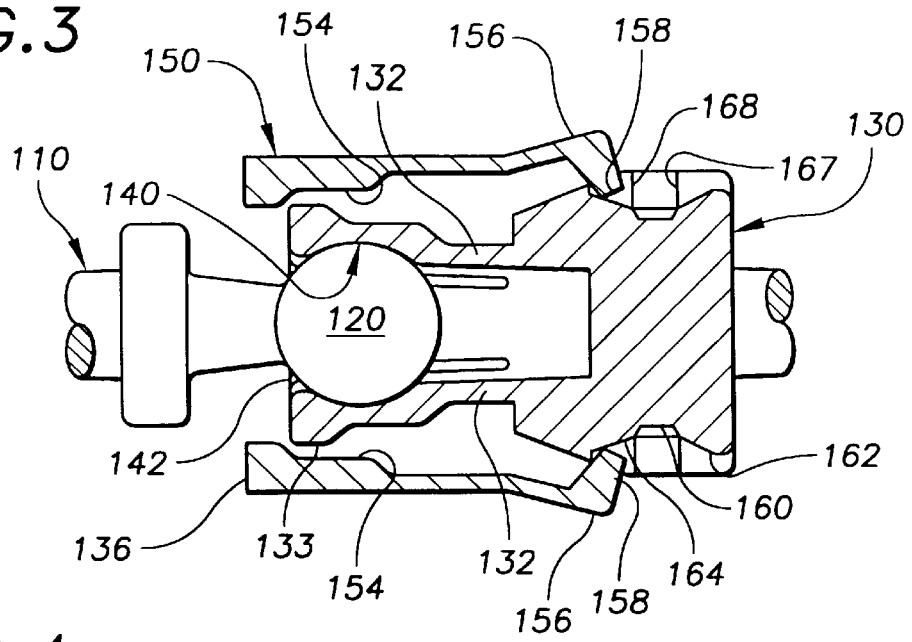
FIG. 3 is a partial sectional view of the buckle of FIG. 1 configured to release and preferably to connect the mating portions thereof.

FIGS. 1–3 illustrate a buckle 100 useable for coupling or fastening extremities of web-like materials comprising generally a first buckle portion 110 having a first engagement member 120, and a second buckle portion 130 having at least two and preferably three or more resilient socket arms 132 forming a socket 140 with a socket opening 142. The first engagement member 120 of the first buckle portion 110 is releasably engageable by the socket 140 of the second buckle portion 130, and more particularly is insertable therein for connection thereto and releasable therefrom through the socket opening 142 as discussed further below.

The buckle 100 also comprises generally a sleeve member 150 reciprocatably disposed about the socket arms 132 of the second buckle portion 130. The sleeve member 150 is reciprocatable relative to the second buckle portion 130 between a first position and at least a second position. Generally, in the first position, the sleeve member 150 is positioned to prevent expansion of the resilient socket arms 132 so as to securely retain the engagement member 120 in the socket 140. In the second position, the sleeve member 150 is positioned to permit expansion of the socket arms 132 thus allowing the release or insertion of the engagement member 120 from or into the socket 140.

The resilient arms 132 are preferably biased in the relatively closed configuration illustrated in FIGS. 1-3 so that the resilient arms 132 envelop and retain the engagement member 120. Thus when the sleeve member 150 is in the first position, the sleeve member 150 prevents outward expansion of the resilient arms 132, as discussed further below. The resilient arms 132 are flexible outwardly against the bias so as to expand the resilient arms 132 outwardly away from each other to permit insertion and release of the engagement member 120 when the sleeve member 150 is moved to the second position, and in some embodiments when the sleeve member 150 is moved to a third position, to allow outward expansion of the resilient arms 132 so as to engage or release the engagement member 120, as discussed further below.

It is generally desirable for the resilient arms to be biased in the relatively closed direction as discussed above, although in other applications it may be advantageous for the resilient arms to be biased outwardly, for example where ease of buckle release is paramount. Thus alternatively and equivalently, the resilient arms may be biased in the outwardly expanded configuration and flexible inwardly against the outward bias so as to retain the engagement member when the sleeve member is moved to the first position so as to constrict the resilient arms inwardly against the outward bias. The resilient arms are then expandable outwardly when the sleeve member is moved to the second or third positions so as to engage or release the engagement member.

FIG. 1 illustrates the sleeve member 150 in the first position relative to the second buckle member 130 wherein the sleeve member 150 is disposed about a portion of the socket arms 132 so as to prevent expansion thereof thereby securely retaining the engagement member 120 in the socket 140. FIG. 1 illustrates more particularly an inner diameter portion 152 of the sleeve member 150 sized slightly larger than an outer diameter portion 133 of the socket arms 132 so as to permit reciprocation of the sleeve member 150 relative to the second body member 130 but to prevent outward expansion of the socket arms 132 at least to an extent that permits release of the engagement member 120 from the socket 140 when the sleeve member 150 is in the first position.

FIG. 2 illustrates the sleeve member 150 in the second position relative to the second buckle member 130 wherein the sleeve member 150 is disposed about another portion of the socket arms 132 so as to permit expansion of the socket arms 132 generally to release or insert the engagement member 120 from and into the socket 140. FIG. 2 illustrates more particularly an outer diameter portion 135 of the socket arms 132 sized smaller than the inner diameter portion 152 of the sleeve member 150 so as to permit outward expansion of the socket arms 132 at least to an extent that permits release or insertion of the engagement member 120 from or into the socket 140 when the sleeve member 150 is in the second position.

In the exemplary embodiment of FIGS. 1–3, the sleeve member 150 is alternatively and preferably also reciprocatable relative to the second buckle portion 130 between the first position and a third position. FIG. 3 illustrates the sleeve member 150 in the third position relative to the second buckle member 130 wherein the sleeve member 150 is disposed about a portion of the socket arms 132 so as to permit expansion of the socket arms 132 generally to insert or release the engagement member 120 into or from the socket 140. FIG. 3 illustrates more particularly the sleeve member 150 having a sleeve recess portion 154 on an inner portion thereof so as to permit or accommodate outward expansion of the socket arms 132 at least to an extent that permits insertion or release of the engagement member 120 into or from the socket 140 when the sleeve member 150 is in the third position.

More generally the sleeve position illustrated in FIG. 2 may be considered the third position and the sleeve position illustrated in FIG. 3 may be considered the second position. Thus according to this alternative convention, the socket arms 132 are expandable into the sleeve recess portion 154 when the sleeve member 150 is in the second position. Notably, it is only necessary for the sleeve member 150 to be movable to one of the second or third positions so as to permit insertion of the engagement member 120 into and withdrawal thereof from the socket 140, although the sleeve member 150 is preferably movable to both the second and third positions.

In FIGS. 1–3, the socket opening 142 is disposed generally on an end portion of the second buckle portion 130, and more particularly on a corresponding end portion 136 of the socket arms 132. FIG. 2 illustrates the sleeve member 150 in the second position moved generally axially away from the socket opening 142 on the end portion 130 of the second buckle portion, and FIG. 3 illustrates the sleeve member 150 in the third position moved generally axially toward the socket opening 142 on the end portion 130 of the second buckle portion. In FIGS. 1–3, the sleeve member 150 is preferably reciprocatable between the first and second and third positions. Preferably, the engagement member 120 is insertable into the socket 140 for connection therewith when the sleeve member 150 is in the third position illustrated in FIG. 3, and the engagement member 120 is releasable from the socket 140 when the sleeve member 150 is in the second position illustrated in FIG. 2 as discussed further below.

In a preferred mode of operation, for the exemplary embodiment of FIGS. 1–3, the first engagement member 120 is inserted into the socket 140 through the socket opening 142 upon grasping the sleeve member 150 and depressing the engagement member 120 against the socket opening 142, thereby moving the sleeve member 150 into the third position, illustrated in FIG. 3, relative to the second buckle portion 130 where the socket arms 132 are expandable so as to permit insertion of the engagement member 120 into the socket 140, as discussed generally above. Thereafter, the sleeve member 150 is returned to the first position where it will retain the engagement member 120 in the socket 140. The first engagement member 120 is released from the socket 140 through the socket opening 142 upon grasping the sleeve member 150 and pulling on the engagement member 120, thereby moving the sleeve member 150 to the second position, illustrated in FIG. 2, relative to the second buckle portion 130 where the socket arms 132 are expandable so as to permit withdrawal of the engagement member 120 from the socket 140, as discussed above.

According to the present invention, illustrated in FIGS. 1-3, the retention and release features of the mating buckle portions are separate. The engagement member 120 of the first buckle portion 110 is retained by the resilient arms 132 of the second buckle portion 130 when the sleeve member 150 is in the first position. To release the first and second buckle portions, the sleeve member 150 is moved, relative to the second buckle portion 130, from the first position to either the second or third position. Separation of the retention and release features has an advantage that the force required to move the sleeve member 150 is generally independent of the load on the buckle. Also, the size and hence strength of the locking feature, and more particularly the resilient arms 1320 and engagement member 120, generally may be increased to increase buckle retention strength without increasing the force required to operate the release feature, and more particularly the force required to move the sleeve member 150. These are significant advantages over prior art locking buckles.

In one embodiment, illustrated in FIGS. 1–3, the first engagement member 120 has a generally spherical portion so as to permit rotational and pivotal movement of the engagement member 120 relative to the socket 140 when the engagement member 120 is retained therein. The generally spherical portion of the engagement member 120 is defined generally to include any shape, for example a ball or curved shaped portion, that is retainable in a socket and at the same time permits rotational and pivotal movement of the engagement member 120 relative thereto.

In one embodiment, illustrated in FIGS. 1–3, the sleeve member 150 includes at least one, and preferably two, resilient arms 156 each having a corresponding sleeve engagement member 158 protruding toward the second buckle portion 130. The second buckle portion 130 includes a recess portion 160, corresponding to each sleeve engagement member 158, having a corresponding first ramp portion 162, and preferably a corresponding second ramp portion 164 disposed opposite the corresponding first ramp portion 162. FIG. 1 illustrates the sleeve engagement member 158 disposed in the recess portion 160 when the sleeve member 150 is in the first position.

In operation, as the sleeve member 150 is moved from the first position to either the second or third positions, the one or more sleeve engagement members 158 move along the corresponding first or second ramp portion 162 or 164, flexing the corresponding resilient arm 156 outwardly. FIG. 2 illustrates the sleeve engagement member 158 slidable upwardly along the first ramp portion 162 as the sleeve member 150 moves to the second position, and FIG. 3 illustrates the sleeve engagement member 158 slidable upwardly along the second ramp portion 164 as the sleeve member 150 moves to the third position.

The one or more resilient arms 156 bias the corresponding sleeve engagement members 158 toward the corresponding recess portions 160, and more particularly the ramped portions 162 and 164 are inclined so that the flexed resilient arms 156 will cause the corresponding sleeve engagement member 158 to slide back downwardly along the ramp portions 162 and 164 to seat in the corresponding recess portions 160, whereby the sleeve member 150 is biased to the first position illustrated in FIG. 1.

In one embodiment, the sleeve member 150 is rotatable relative to the second buckle portion 130 when the sleeve member 150 is in the first position so as to lock the sleeve member 150 in the first position, thereby preventing the sleeve member 150 from being reciprocated, or moved, from the first position to one of the second or third positions, illustrated in FIGS. 2 and 3 as discussed above.

Figure 4A:
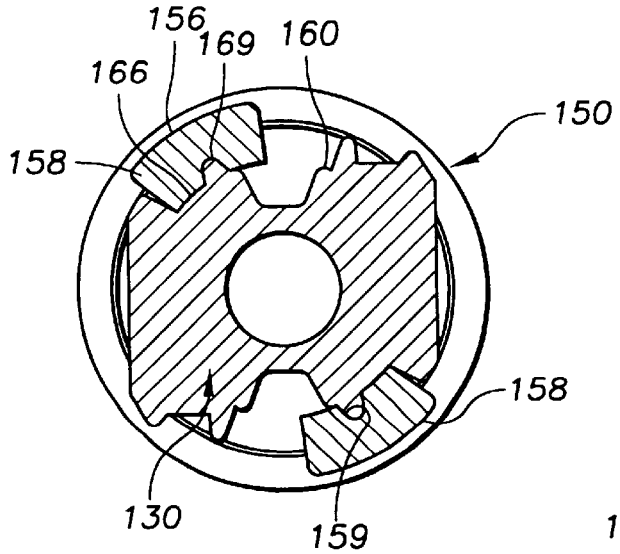
FIG. 4*a* is a partial sectional view along lines a-a of the buckle FIG. 1 in a locked configuration.
Figure 4B:
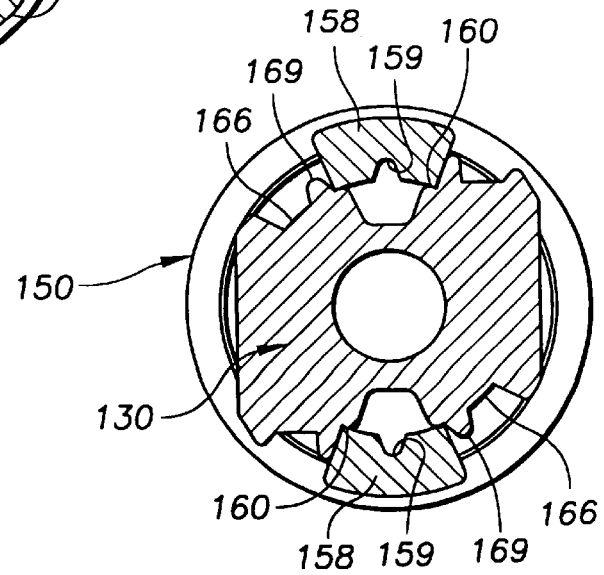
FIG. 4*b* is a partial sectional view of the buckle of FIG. 1 in an unlocked configuration.

The sleeve member 150 is locked in the first position by locking engagement between a portion of the sleeve member 150 and the second buckle portion. In FIGS. 1, 4*a* and 4*b*, the second buckle portion 130 includes a recess locking portion 130 166 for accommodating a corresponding sleeve engagement member 158 when the sleeve member 150 is rotated relative to the second buckle member 130 so as to lock the sleeve member 150 in the first position.

FIGS. 4*a* and 4*b* illustrate the recess locking portion 166 formed on the second buckle member 130 adjacent to the recess portion 160 so that each sleeve engagement member 158 is movable between the corresponding recess portion 160 and the corresponding adjacent recess locking portion 166 upon rotation of the sleeve member 150 about the second buckle portion 130. FIGS. 1 and 3 illustrate the recess locking portion 166 distinguished from the recess portion 160 by the presence of relatively steep side wall portions 167 and 168 which retain the corresponding sleeve engagement member 158 and prevent the axial reciprocation, or movement, thereof, thereby locking the sleeve member 150 in the first position.

FIGS. 4*a* and 4*b* illustrate the recess locking portions 166 each preferably including a corresponding protruding member 169 extending therefrom toward the sleeve member 150 and extendable into a corresponding recess 159 disposed on an end portion of the sleeve engagement member 158 when the sleeve engagement member 158 is positioned in the recess locking portion 166. The protruding member 169 rotationally locks the sleeve member 150 relative to second buckle portion 130, thereby preventing unintentional or casual rotation therebetween and possible release of the engagement member 120 from the socket 140.

FIG. 1 illustrates the first buckle member 110 having a first strap engagement portion 102 generally opposite the first engagement member 120, and the second buckle portion 130 having a second strap engagement portion 104 generally opposite the socket 140. The first and second strap engagement portions 102 and 104 are generally in the form of a bar for accommodating a corresponding strap portion disposed thereabout as is known generally in the art. The first and second strap engagement portions 102 and 104 may alternatively be in the form of adjustable strap couplings, known commercially as LADDERLOCS available on buckles from ITW Nexus, Des Plaines, Ill.

Figure 5:
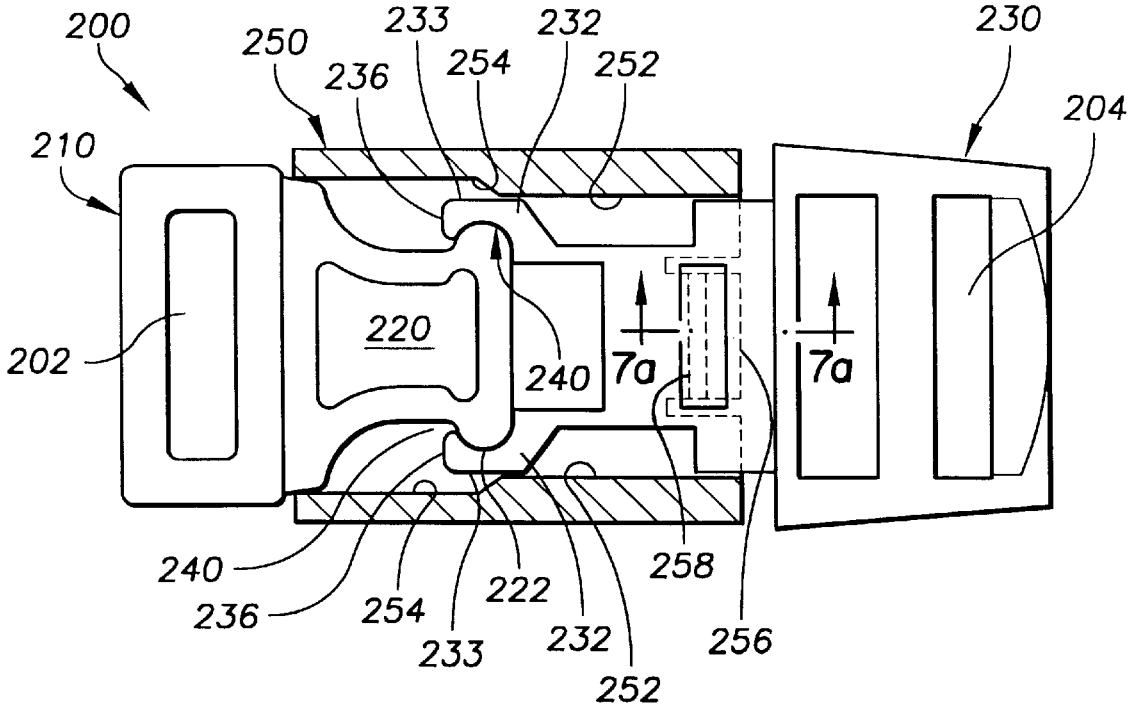
FIG. 5 is a partial sectional view of a buckle having first and second mating portions according to another exemplary embodiment of the invention.
Figure 6:
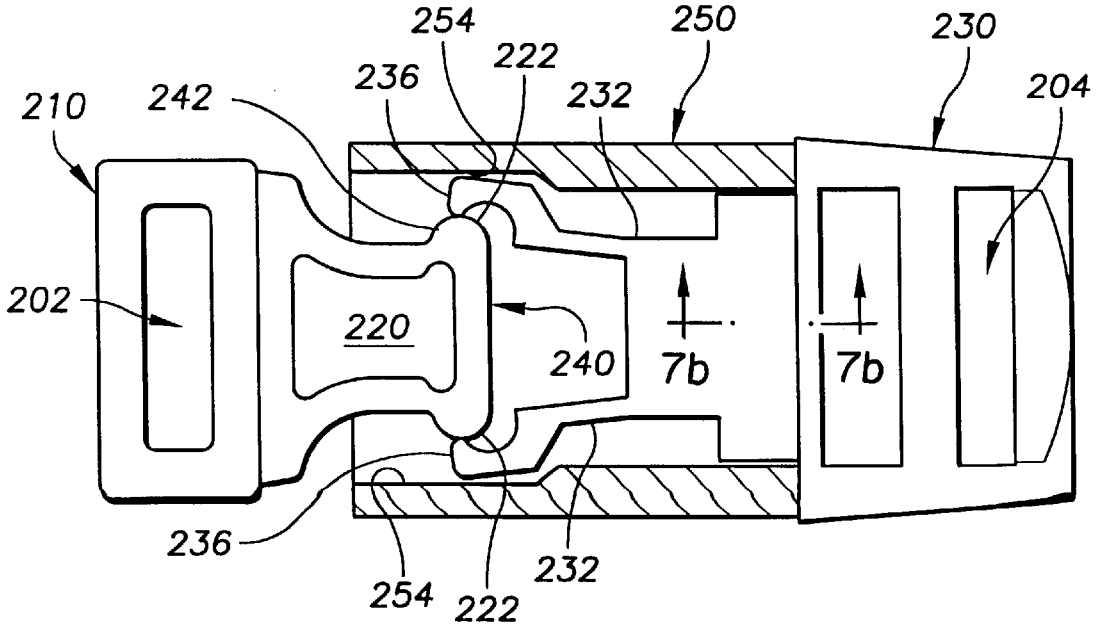
FIG. 6 is a partial sectional view of the buckle of FIG. 5 configured to release or connect the mating portions thereof.

FIGS. 5 and 6 illustrate another buckle 200 useable for coupling or fastening extremities of web-like materials comprising generally a first buckle portion 210 having a first engagement member 220, and a second buckle portion 230 having at least two resilient socket arms 232 forming a socket 240 with a socket opening 242. The first engagement member 220 of the first buckle portion 210 is releasably engageable by the socket 240 of the second buckle portion 230, and more particularly is insertable therein and releasable therefrom through the socket opening 242 as discussed further below.

The buckle 200 also comprises generally a sleeve member 250 reciprocatably disposed about the socket arms 232 of the second buckle portion 230. The sleeve member 250 is reciprocatable relative to the second buckle portion 230 between a first position and a second position. Generally, in the first position, the sleeve member 250 is positioned so as to prevent expansion of the resilient socket arms 232, or equivalently to constrict the socket arms 232 depending on the bias thereof as discussed above, so as to securely retain the engagement member 220 in the socket 240. In the second position, the sleeve member 250 is positioned so as to permit expansion of the resilient socket arms 232 thus allowing the release or insertion of the engagement member 220 from or into the socket 240.

FIG. 5 illustrates the sleeve member 250 in the first position relative to the second buckle member 230 wherein the sleeve member 250 is disposed about a portion of the socket arms 232 so as to prevent expansion thereof, thereby securely retaining the engagement member 220 in the socket 240. FIG. 5 illustrates more particularly an inner portion 252 of the sleeve member 250 sized slightly larger than an outer portion 233 of the socket arms 232 so as to permit reciprocation of the sleeve member 250 relative to the second body member 230 but to prevent outward expansion of the socket arms 232 at least to an extent that permits release of the engagement member 220 from the socket 240 when the sleeve member 250 is in the first position.

FIG. 6 illustrates the sleeve member 250 in the second position relative to the second buckle member 230 wherein the sleeve member 250 is disposed about another portion of the socket arms 232 so as to permit expansion of the socket arms 232 generally to release or insert the engagement member 220 from and into the socket 240. FIG. 6 illustrates more particularly the sleeve member 250 having a sleeve recess portion 254 on an inner portion thereof so as to permit or accommodate outward expansion of the socket arms 232 at least to an extent that permits insertion or release of the engagement member 220 into or from the socket 240 when the sleeve member 250 is in the second position.

In FIGS. 5 and 6, the first engagement member 220 is a tongue member having lobe portions 222 protruding from opposite sides thereof toward an end portion of the tongue, and the socket opening 242 is disposed generally on an end portion of the second buckle portion 230, and more particularly on a corresponding end portion 236 of the socket arms 232. FIG. 6 illustrates the sleeve member 250 in the second position moved generally axially away from the socket opening 242 on the end portion 230 of the second buckle portion toward a second strap engagement portion 204 of the second buckle portion 230.

In FIGS. 5 and 6, the sleeve member 250 is preferably reciprocatable between the first and second positions, whereby the engagement member 220 is retained in the socket 240 when the sleeve member 250 is in the first position and the engagement member 220 is insertable into and releasable from the socket 240 when the sleeve member 250 is in the second position. More particularly, the first engagement member 220 is inserted into the socket 240 through the socket opening 242 upon positioning the sleeve member 250 to the second position and depressing the engagement member 220 against the socket opening 242 so as to expand the socket arms 232 and insert the engagement member 220 into the socket 240, as illustrated in FIG. 5. Thereafter, the sleeve member 250 is returned to the first position where it retains the engagement member 220 in the socket 240. The first engagement member 220 is released from the socket 240 through the socket opening 242 upon grasping the sleeve member 250 and pulling on the engagement member 220, thereby moving the sleeve member 250 into the second position relative to the second buckle portion 230 whereupon the socket arms 232 are expandable so as to permit withdrawal of the engagement member 220 from the socket 240, as illustrated in FIG. 6.

The retention and release features of the mating buckle portions of FIGS. 5 and 6 are also separate and provide the same advantages discussed above in connection with separate retention and release features of FIGS. 1–3.

Figure 7A:
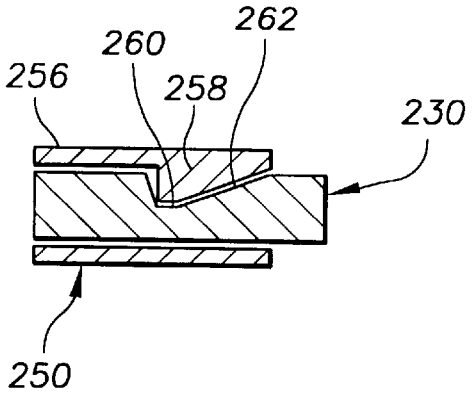
FIG. 7*a* is a partial sectional view along lines a—a of FIG. 5.
Figure 7B:
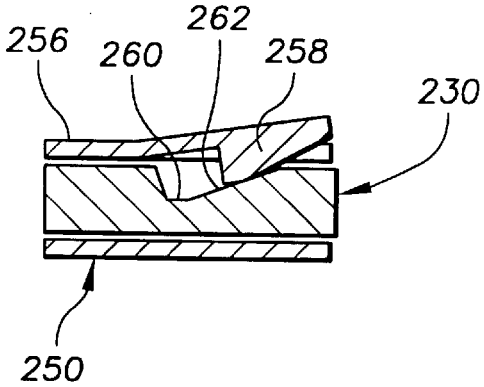
FIG. 7*b* is a partial sectional view along lines b—b of FIG. 6.

In FIGS. 5, 7*a* and 7*b*, the sleeve member 250 includes at least one, and preferably two, resilient arms 256 each having a corresponding sleeve engagement member 258 protruding toward the second buckle portion 230. The second buckle portion 230 includes a recess portion 260, corresponding to each sleeve engagement member 258, having a corresponding first ramp portion 262. FIG. 7*a* illustrates the sleeve engagement member 258 disposed in the recess portion 260 when the sleeve member 250 is in the first position.

In operation, as the sleeve member 250 is moved from the first position to the second position, the sleeve engagement member 258 moves along the first ramp portion 262, flexing the corresponding resilient arm 256 outwardly. FIG. 7*b* illustrates the sleeve engagement member 258 slidable upwardly along the first ramp portion 262 as the sleeve member 250 moves to the second position. The resilient arm 256 biases the corresponding sleeve engagement member 258 toward the corresponding recess portions 260, and more particularly the ramped portion 262 is inclined so that the flexed resilient arm 256 will cause the corresponding sleeve engagement member 258 to slide back downwardly along the ramp portion 262 to seat in the corresponding recess portion 260, whereby the sleeve member 250 is biased to the first position illustrated in FIGS. 5 and 7*a*.

FIGS. 5 and 6 illustrate the first buckle member 210 having a first strap engagement portion 202 generally opposite the first engagement member 220, and the second buckle portion 230 having a second strap engagement portion 204 generally opposite the socket 240. The first strap engagement portion 202 is a single opening or slot disposed through the buckle portion for accommodating a corresponding strap portion 210 disposed therethrough as is known generally in the art. The second strap engagement portion 204 is in the form of a LADDERLOC, which permits adjustable coupling of the corresponding strap portion thereto as is known generally.

Figure 8A:
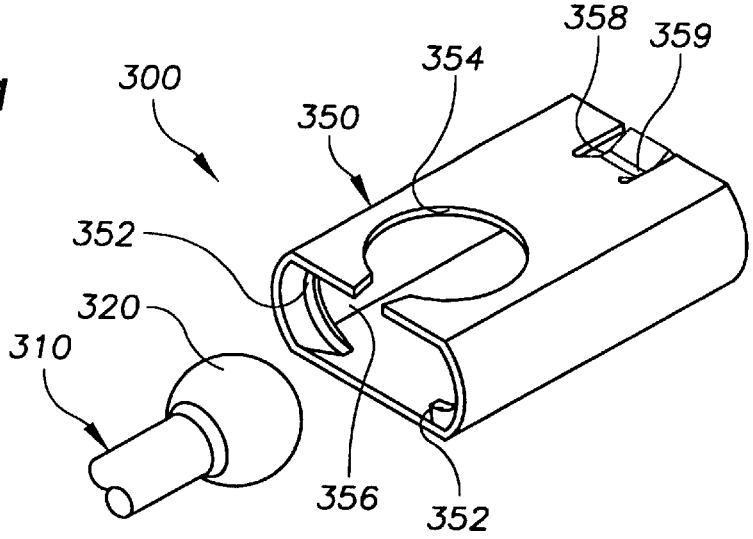
FIGS. 8*a* and 8*b* are perspective views of first and second mating buckle portions according to yet another exemplary embodiment of the invention.
Figure 8B:
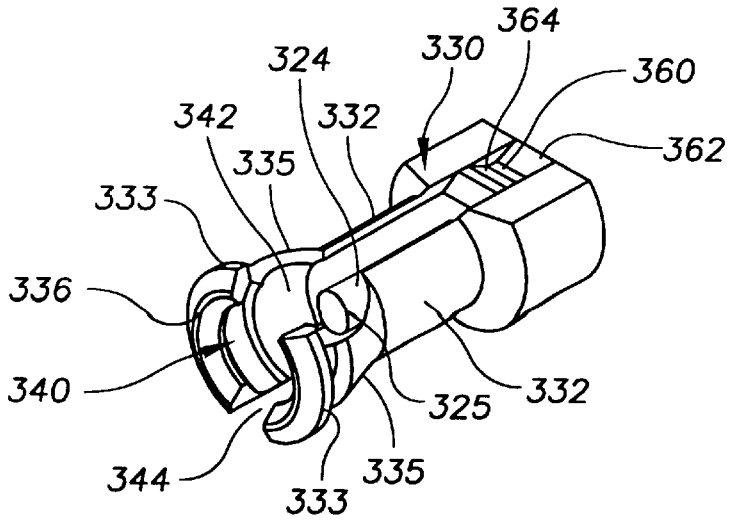

FIGS. 8*a* and 8*b* illustrate another buckle 300 useable for coupling or fastening extremities of web-like materials comprising generally a first buckle portion 310 having a first engagement member 320 preferably including a generally spherical portion, as discussed above in connection with the embodiments of FIGS. 1–3, and a second buckle portion 330 having at least two resilient socket arms 332 forming a socket 340 with a socket opening. The first engagement member 320 of the first buckle portion 310 is releasably engageable by the socket 340 of the second buckle portion 330, and more particularly is insertable therein and releasable therefrom through the socket opening as discussed further below.

The buckle 300 also comprises a sleeve member 350 reciprocatably disposable about the socket arms 332 of the second buckle portion 330, and more particularly between a first position and at least a second position, and preferably also between the first position and a third position. Generally, in the first position, the sleeve member 350 is positioned so as to prevent expansion of the resilient socket arms 332, or equivalently to constrict the socket arms 332 depending on the bias thereof as discussed above, to securely retain the engagement member 320 in the socket 340. In the second position, the sleeve member 350 is positioned so as to permit expansion of the socket arms 332 thus allowing the release or insertion of the engagement member 320 from or into the socket 340.

In the first position, the sleeve member 350 is disposed about a portion of the socket arms 332 so as to prevent expansion thereof thereby securely retaining the engagement member 320 in the socket 340. FIGS. 8*a* and 8*b* illustrate more particularly an inner diameter portion 352 of the sleeve member 350 sized slightly larger than an outer diameter portion 333 of the socket arms 332 so as to permit reciprocation of the sleeve member 350 relative to the second body member 330 but to prevent outward expansion of the socket arms 332 at least to an extent that permits release of the engagement member 320 from the socket 340 when the sleeve member 350 is in the first position in a manner discussed generally above in connection with the embodiments of FIGS. 1 and 5.

In the second position, the sleeve member 350 is disposed about another portion of the socket arms 332 so as to permit expansion of the socket arms 332 generally to release or insert the engagement member 320 from and into the socket 340. FIGS. 8*a* and 8*b* illustrate more particularly an outer diameter portion 335 of the socket arms 332 sized smaller than the inner diameter portion 352 of the sleeve member 350 so as to permit outward expansion of the socket arms 332 at least to an extent that permits release or insertion of the engagement member 320 from or into the socket 340 when the sleeve member 350 is in the second position, whereby a portion of the socket 340 protrudes from the sleeve member 350 in a manner discussed generally above in connection with the embodiment of FIG. 2.

In FIG. 8*b*, the second buckle portion 330 also comprises a resilient anti-backout arm 324 disposed between the resilient arms 332 and extending, or protruding, partially into the socket 340. And the socket 340 has a first socket opening 342 disposed on a side portion of the second buckle portion 330, and the sleeve member 350 has a corresponding sleeve opening 354 alignable with the first socket opening 342.

In one mode of operation, of the embodiment in FIGS. 8*a* and 8*b*, the spherical portion of the engagement member 320 is disposable into the socket 340 through the sleeve opening 354 on the side portion of the sleeve member 350 and the first socket opening 342 on the side portion of the second buckle portion 330 when the sleeve opening 354 is aligned with the first socket opening 342, preferably when the sleeve member 330 is in the first position so as to prevent expansion of the resilient socket arms 332. More particularly, as the engagement member 320 is disposed through the first socket opening 342, it engages an end portion 325 of the resilient anti-backout arm 324 protruding into the socket 340, which flexes the resilient anti-backout arm, 324 downwardly thereby allowing insertion of the spherical portion of the engagement member 320 into the socket 340. Thereafter, the resilient anti-backout arm 324 flexes back to its original position, which moves the engagement member 320 axially away from the anti-backout arm 324 thereby seating the engagement member 320 in the socket 340 where it is retained securely. The anti-backout arm 324 prevents the engagement member 320 from being withdrawn subsequently from the socket 340 through the first socket opening 342.

The second buckle portion 330 and more particularly the socket 340 thereof also comprises a second socket opening 344 disposed on an end portion 336 of the resilient arms 332, as discussed above generally in connection with the embodiments of FIGS. 1 and 5. The spherical portion of the first engagement member 320 is generally removable from the socket 340 through the second socket opening 344 when the socket arms are expandable outwardly, and more particularly when the sleeve member 350 is moved to the second position so that the socket arms 320 are expandable so as to release the engagement member 320 during withdrawal thereof from the socket 340. More particularly, the engagement member 320 is released from the socket 340 through the second socket opening 344 upon grasping the sleeve member 350 and pulling on the engagement member 320 away therefrom, thereby moving the sleeve member 350 into the second position relative to the second buckle portion 330 where the socket arms 332 are expandable so as to permit withdrawal of the engagement member 320 from the socket 340, as discussed above generally in connection with the embodiments of FIGS. 2 and 6.

In another embodiment, the sleeve member 350 is also reciprocatable relative to the second body portion 330 between the first position and a third position. Generally, in the third position, the sleeve member 350 is positioned so as to permit expansion of the socket arms 332 generally to insert or release the engagement member 320 into or from the socket 340. FIGS. 8*a* and 8*b* illustrate the sleeve member 350 having a sleeve recess portion 356 on an inner portion thereof so as to permit or accommodate outward expansion of the socket arms 332 at least to an extent that permits insertion or release of the engagement member 320 into or from the socket 340 when the sleeve member 350 is in the third position in a manner discussed generally above in connection with the embodiment of FIG. 3.

In another mode of operation, for the exemplary embodiment of FIGS. 8*a* and 8*b*, the first engagement member 320 is alternatively insertable into the socket 340 through the second socket opening 344 on the end portion of the second buckle portion 330 upon grasping the sleeve member 350 and depressing the engagement member 320 against the second socket opening 344, thereby moving the sleeve member 350 into the third position relative to the second buckle portion 330 where the socket arms 332 are expandable to permit insertion of the engagement member 320 into the socket 340. Thereafter, the sleeve member 350 is returned to the first position where it retains the engagement member 320 in the socket 340 in a manner discussed generally above in connection with the embodiment of FIG. 3.

In another embodiment, illustrated in FIGS. 8*a* and 8*b*, the sleeve member 350 includes at least one, and preferably two, resilient arms 358 each having a corresponding sleeve engagement member 359 protruding toward the second buckle portion 330 when the sleeve member 350 is assembled therewith. The second buckle portion 330 includes a recess portion 360, corresponding to each sleeve engagement member 359, having a corresponding first ramp portion 362, and preferably a corresponding second ramp portion 364 opposite the corresponding first ramp portion 362. The sleeve engagement member 359 is disposed in the recess portion 360 when the sleeve member 350 is in the first position relative to the second buckle portion 330.

In operation, as the sleeve member 350 is moved from the first position to either the second or third positions, the sleeve engagement member 359 moves along the corresponding first or second ramp portion 362 or 364, flexing the corresponding resilient arm 358 outwardly. The sleeve engagement member 359 is slidable upwardly along the first ramp portion 362 as the sleeve member 350 moves to the second position, and the sleeve engagement member 359 is slidable upwardly along the second ramp portion 364 as the sleeve member 350 moves to the third position.

The retention and release features of the mating buckle portions of FIGS. 8*a* and 8*b* are also separate and provide the same advantages discussed above in connection with the retention and release features of FIGS. 1–6.

The one or more resilient arms 355 bias the corresponding sleeve engagement members 359 toward the corresponding recess portions 360, and more particularly the ramped portions 362 and 364 are inclined so that the flexed resilient arm 358 will cause the corresponding sleeve engagement member 359 to slide back downwardly along the ramp portions 362 and 364 to seat in the corresponding recess portions 360, whereby the sleeve member 350 is biased to the first position in a manner discussed generally above in connection with the embodiment of FIG. 1.

The embodiments of FIGS. 8*a* and 8*b* may also be configured so that the sleeve member 350 is rotatable relative to the second buckle portion 330 when the sleeve member 350 is in the first position so as to lock the sleeve member 350 in the first position, thereby preventing the sleeve member 350 from being reciprocated, or moved, from the first position to one of the second or third positions in a manner discussed generally above in connection with the embodiments of FIGS. 1–3.

The embodiments of FIGS. 8*a* and 8*b* may also be configured to include a first strap engagement portion generally opposite the first engagement member 320, and a second strap engagement portion generally opposite the socket 340 of the second buckle portion 330 as discussed above generally in connection with the other embodiments disclosed herein.

While the foregoing written description of the invention enables one of ordinary skill to make and use what is considered presently to be the best mode thereof, those of ordinary skill will understand and appreciate the existence of variations, combinations, and equivalents of the specific exemplary embodiments herein. The invention is therefore to be limited not by the exemplary embodiments herein, but by all embodiments within the scope and spirit of the appended claims.

What is claimed is:

1. A buckle comprising:

a first buckle portion having an engagement member;

a second buckle portion having at least two resilient axially extending socket arms forming a socket, having a socket opening, wherein said engagement member of said first buckle portion is releasably engageable with said socket of said second buckle portion; and a sleeve member reciprocatably disposed about said socket arms of said second buckle portion so as to be movable between first, second, and third axial positions with respect to said socket wherein when said sleeve member is disposed at said first axial position with respect to said socket of said second buckle portion, said socket arms are prevented from being expanded so as to maintain said engagement member of said first buckle portion within said socket of said second buckle portion, when said sleeve member is disposed at said second axial position with respect to said socket of said second buckle portion, said socket arms are expandable so as to permit said engagement member of said first buckle portion to be released from said socket of said second buckle portion, and when said sleeve member is disposed at said third axial position with respect to said socket of said second buckle portion, said socket arms are expandable so as to permit said engagement member of said first buckle portion to be inserted into said socket of said second buckle portion.

2. The buckle of claim 1, wherein the sleeve member includes at least one resilient arm having a sleeve engagement member protruding toward the second buckle portion, the second buckle portion has a recess portion with a first ramp portion, the sleeve engagement member being disposed in the recess portion when the sleeve member is in the first position, and the sleeve engagement member being slidable along the first ramp portion as the sleeve member moves to the second position.

3. The buckle of claim 2, wherein:

said recess portion of said second buckle portion has a second ramp portion disposed opposite said first ramp portion; and said sleeve engagement member is slidable along said second ramp portion as said sleeve member moves to said third position.

4. The buckle of claim 1, wherein the sleeve member has a sleeve recess portion on an inner portion thereof, the socket arms being expandable into the sleeve recess portion when the sleeve member is in the second position.

5. The buckle of claim 1, wherein the sleeve member has a sleeve recess portion on an inner portion thereof, the socket arms being expandable into the sleeve recess portion when the sleeve member is in the third position.

6. The buckle of claim 1, wherein the first buckle member has a first strap engagement portion generally opposite the engagement member, and the second buckle portion has a second strap engagement portion generally opposite the socket.

7. The buckle of claim 1, wherein the sleeve member has a sleeve engagement member, the sleeve member rotatable relative to the second buckle portion when the sleeve member being is in the first position to engage the sleeve engagement member with the second buckle portion so as to lock the sleeve member in the first position so as.

8. The buckle of claim 1, wherein the engagement member has a generally spherical portion, the socket opening is disposed on an end portion of the second buckle portion, and spherical portion of the engagement member is disposable into the socket through the socket opening when the socket arms are expandable outwardly.

9. The buckle of claim 8, wherein:

said sleeve member includes at least one resilient arm having a sleeve engagement member protruding toward said second buckle portion;

said second buckle portion has a recess portion with a first ramp portion and a second ramp portion disposed opposite said first ramp portion; and said sleeve engagement member is disposed in said recess portion when said sleeve member is in the first position, said sleeve engagement member is slidable along said first ramp portion as said sleeve member moves to said second position, and said sleeve engagement member is slidable along said second ramp portion as said sleeve member moves to said third position.

10. The buckle of claim 9, wherein, the sleeve member has a sleeve recess portion on an inner portion thereof, the socket arms being expandable into the sleeve recess portion when the sleeve member is in the third position, the sleeve member being positioned toward the socket opening in the third position and the sleeve member being positioned away from the socket opening in the second position and, the spherical portion of the first engagement member is insertable into the socket when the sleeve member is in the third position and the spherical portion of the first engagement member is releasable from the socket when the sleeve member is in the second position.

11. The buckle of claim 9, wherein the second buckle portion has a recess locking portion and, the sleeve member is rotatable relative to the second buckle portion when the sleeve member is in the first position so as to move the sleeve engagement member into the recess locking portion to lock the sleeve member in the first position.

12. The buckle of claim 1, wherein said engagement member is a tongue member having lobe portions protruding from opposite sides of an end portion and of the tongue, the socket opening is disposed on an end portion of the second buckle portion, the lobe portions of the tongue member are disposable into the socket through the socket opening when the socket arms are expandable outwardly.

13. The buckle of claim 12, wherein the sleeve member includes at least one resilient arm having a sleeve engagement member protruding toward the second buckle portion, the second buckle portion has a recess portion with a corresponding first ramp portion, the sleeve engagement member disposed in the recess portion when the sleeve member is in the first position, and the sleeve engagement member slidable along the first ramp portion as the sleeve member moves to the second position.

14. The buckle of claim 12, wherein the sleeve member has a sleeve recess portion on an inner portion thereof, the socket arms being expandable into the sleeve recess portion when the sleeve member is in the second position.

15. A buckle, comprising:

a first buckle portion having an engagement member;

a second buckle portion having at least two resilient axially extending socket arms forming a socket, having a socket opening, wherein said engagement member of said first buckle portion is releasably engageable with said socket of said second buckle portion;

a sleeve member reciprocatably disposed about said socket arms of said second buckle portion so as to be movable between first and second axial positions with respect to said socket of said second buckle portion wherein when said sleeve member is disposed at said first axial position with respect to said socket of said second buckle portion, said socket arms are prevented from being expanded so as to maintain said engagement member of said first buckle portion within said socket of said second buckle portion, and when said sleeve member is disposed at said second axial position with respect to said socket of said second buckle portion, said socket arms are expandable so as to permit said engagement member of said first buckle portion to be released from said socket of said second buckle portion, and wherein further, said sleeve member is rotatable relative to said second buckle portion and about said axially extending socket arms of said second buckle portion, between locked and unlocked positions, when said sleeve member is disposed at said first axial position; and first and second locking engagement means respectively provided upon said sleeve member and said second buckle portion for lockingly engaging each other when said sleeve member is disposed at said first axial position with respect to said socket of said second buckle portion and is rotated to said locked position so that said sleeve member cannot be moved to said second axial position with respect to said socket of said second buckle portion whereby said engagement member of said first buckle portion cannot be disengaged from said socket of said second buckle portion.

16. The buckle as set forth in claim 15, wherein:

said locking engagement means of said second buckle portion comprises a recess locking portion; and said locking engagement means of said sleeve member comprises an engagement member for disposition into said recess locking portion of said second buckle portion.

17. A buckle, comprising:

a first buckle portion having an engagement member;

a second buckle portion having at least two resilient axially extending socket arms forming a socket for releasably accommodating said engagement member of said first buckle portion, said socket comprising a first socket opening defined within a side portion of said second buckle portion, and a second socket opening defined within an end portion of said second buckle portion; and a sleeve member reciprocatably disposed about said socket arms of said second buckle portion so as to be movable between first and second axial positions with respect to said socket of said second buckle portion wherein when said sleeve member is disposed at said first axial position with respect to said socket of said second buckle portion, said socket arms are prevented from being expanded so as to maintain said engagement member of said first buckle portion within said socket of said second buckle portion, and when said sleeve member is disposed at said second axial position with respect to said socket of said second buckle portion, said socket arms are expandable so as to permit said engagement member of said first buckle portion to be released from said socket of said second buckle portion, said sleeve member further comprising a first sleeve opening defined within a side portion of said sleeve member and alignable with said first socket opening of said second buckle portion for permitting insertion of said engagement member of said first buckle portion into said socket of said second buckle portion when said first sleeve opening of said sleeve member is aligned with said first socket opening of said second buckle portion, and a second sleeve opening defined within an end portion of said sleeve member and alignable with said second socket opening of said second buckle portion for permitting withdrawal of said engagement member of said first buckle portion from said socket of said second buckle portion when said sleeve member is disposed at said second axial position with respect to said socket of said second buckle portion such that said socket arms are permitted to expand outwardly.

18. The buckle of claim 17, wherein:

said engagement member of said first buckle portion has a generally spherical portion; and said second buckle portion includes a flexibly resilient anti-backout arm disposed between said resilient socket arms and protruding partially into said socket, and being movable away from a first position to a second position so as to permit insertion of said spherical portion of said engagement member into said socket, and movable from said second position back to said first position after said spherical portion of said engagement member has been inserted into said socket so as to prevent withdrawal of said spherical portion of said engagement member out from said socket through said first socket opening.

19. The buckle of claim 18, wherein the sleeve member includes at least one resilient arm having a sleeve engagement member protruding toward the second buckle portion, the second buckle portion has a recess portion with a first ramp portion, the sleeve engagement member being disposed in the recess portion when the sleeve member is in the first position, and the sleeve engagement member being slidable along the first ramp portion as the sleeve member moves to the second position.

20. The buckle of claim 17, wherein:

said sleeve member is reciprocatable between said first position and a third position;

said sleeve member includes at least one resilient arm having a sleeve engagement member protruding toward said second buckle portion;

said second buckle portion has a recess portion with a first ramp portion and a second ramp portion disposed opposite said first ramp portion; and said sleeve engagement member is disposed in said recess portion when said sleeve member is in the first position, said sleeve engagement member is slidable along said first ramp portion as said sleeve member moves to said second position, and said sleeve engagement member is slidable along said second ramp portion as said sleeve member moves to said third position said socket arms also being expandable when said sleeve member is disposed in said third position.

21. The buckle of claim 20, wherein the sleeve member has a sleeve recess portion on an inner portion thereof, the socket arms being expandable into the sleeve recess portion when the sleeve member is in the third position, the sleeve member positioned toward the second socket opening in the third position and the sleeve member positioned away from the second socket opening in the second position, the spherical portion of the first engagement member is insertable into the socket through the second socket opening when the sleeve member is in the third position and the spherical portion of the first engagement member is releasable from the socket through the second socket opening when the sleeve member is in the second position.

* * * * *